United States Patent [19]

Mock

[11] 4,054,802

[45] Oct. 18, 1977

[54] POWER CONTROL CIRCUIT

[75] Inventor: Donovan L. Mock, Marion, Ind.

[73] Assignee: General Motors Corporation, Detroit, Mich.

[21] Appl. No.: 729,090

[22] Filed: Oct. 4, 1976

[51] Int. Cl.[2] ..... H01H 47/32

[52] U.S. Cl. ..... 307/38; 307/112; 361/160

[58] Field of Search ..... 361/160, 170; 307/38, 307/112, 114, 125, 126, 131, 140

[56] References Cited

U.S. PATENT DOCUMENTS

| | | | |
|---|---|---|---|
| 2,507,976 | 5/1950 | Hull | 361/160 X |
| 2,511,071 | 6/1950 | Marmorstein | 179/100.11 |
| 2,534,930 | 12/1950 | Simmons | 179/100.11 |
| 3,343,158 | 9/1967 | Tellerman | 361/170 X |
| 3,416,001 | 12/1968 | Fistell | 307/112 X |

*Primary Examiner*—Harry E. Moose, Jr.
*Attorney, Agent, or Firm*—Warren D. Hill

[57] ABSTRACT

A circuit connected to an AC source has first and second AC outlets for supplying power to first and second load devices. A control circuit response to power drawn from the first outlet controls power supplied to the second outlet such that the second outlet is energized only when current is flowing from the first outlet. Thus a record player or tape deck connected to the first outlet controls the supply of power to an amplifier connected to the second outlet.

1 Claim, 2 Drawing Figures

POWER CONTROL CIRCUIT

Figure 1:
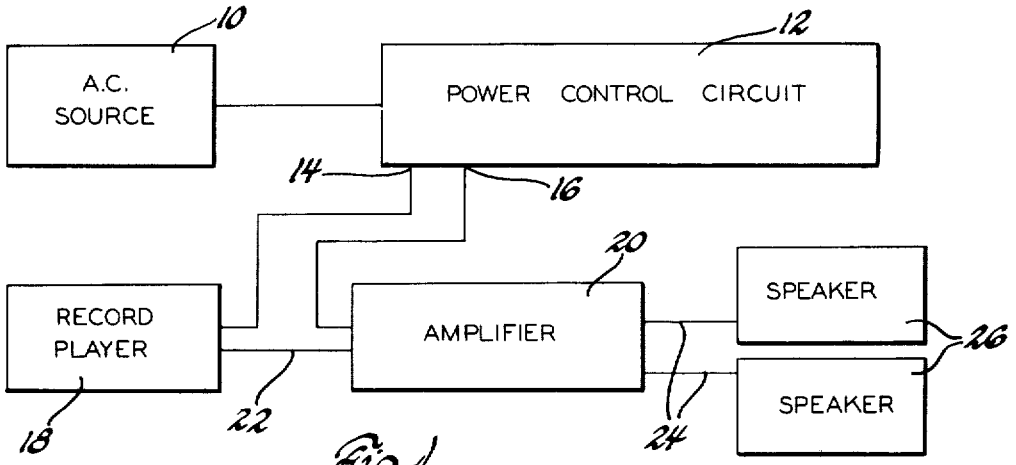

This invention relates to a power control circuit and particularly to such a circuit for transmitting power from an AC source to a load device in accordance with the demand from another load device.

In a home entertainment system made up of several components such as record player, tape deck, amplifiers and speakers, it is commonplace to use record players or other source units which automatically turn off at the end of a selection. It is desirable to turn off the remainder of the system at the same time so that the system is not inadvertently left on for extended periods.

It is therefore a general object of this invention to provide a power control circuit responsive to one load device supplied by the circuit to control the supply of power to another load device supplied by the circuit.

It is a further object to provide such a power control circuit in which a second load device is turned on and off when the first device is turned on and off.

The invention is carried out by providing a circuit for transmitting current from an AC source to each of two outlets. A controlling outlet is connected in series with the base-emitter circuit of a transistor to render the transistor conductive when current is drawn from the controlling outlet. The transistor is connected in series with the coil of a relay so that when the transistor is conductive the relay contacts are closed to energize the controlled outlet.

Figure 2:
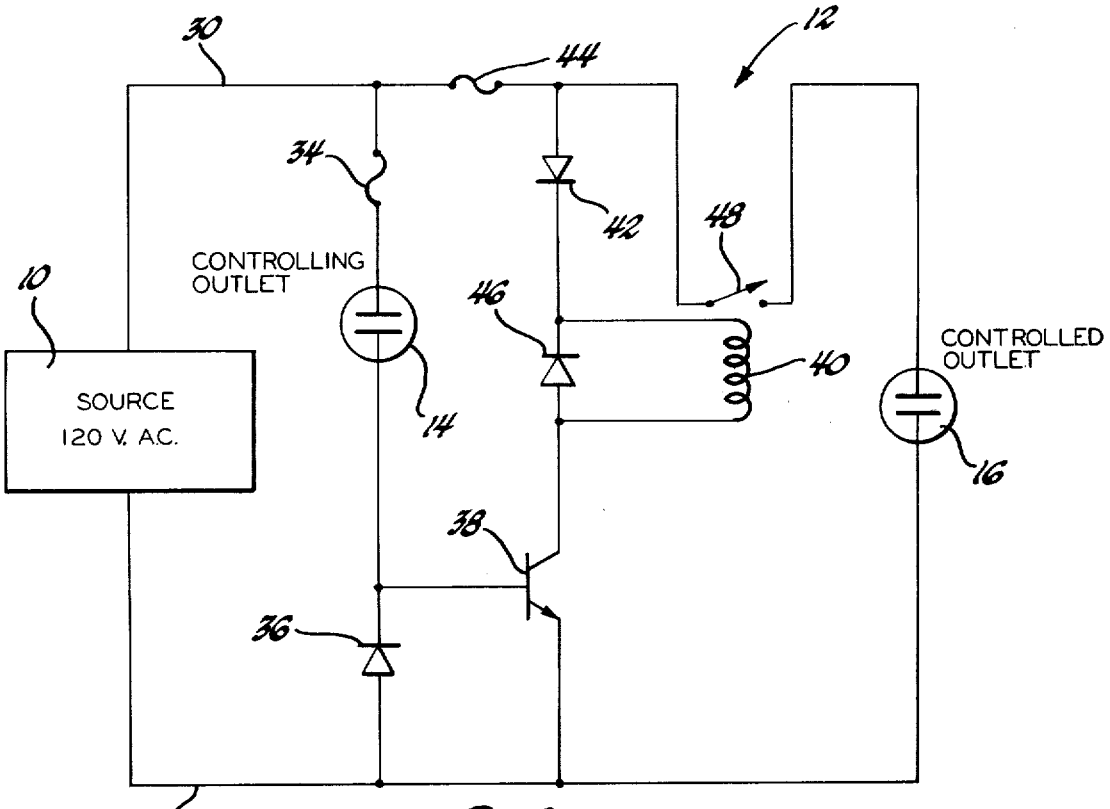

The above and other advantages will be made more apparent from the following specification taken in conjunction with the accompanying drawings wherein like reference numerals refer to like parts and wherein;

FIG. 1 is a block diagram of a system employing a power control circuit according to the invention; and FIG. 2 is a schematic diagram of the power control circuit of FIG. 1.

Referring to FIG. 1, an AC source 10 is electrically connected to the power control circuit 12. The circuit 12 has a controlling outlet 14 and a controlled outlet 16. A record player 18 is connected to the controlling outlet 14 whereas an amplifier 20 is connected to the controlled outlet 16. A signal line 22 connects the record player and the amplifier and a line 24 connects the amplifier with speakers 26. As will be seen in the following description, the controlling outlet 14 is always connected to the AC source 10 so that current is supplied to the record player upon demand. The outlet 16, on the other hand, is connected to the AC source only when current is drawn through the controlling outlet 14 with the result that the amplifier 20 is turned on or off whenever the record player 18 is turned on or off.

Referring now to FIG. 2, the power control circuit 12 includes power lines 30 and 32 connected across the AC source 10. A fuse 34, the controlling output 14 and a diode 36 are serially connected across the lines 30 and 32 with the cathode of the diode being connected to the connector 14. An NPN transistor 38 has its base connected to the cathode of the diode 36 and its emitter connected to the line 32. The transistor collector is connected in series with a relay coil 40 and a diode 42 which is connected through a fuse 44 to the line 30. The diode polarity is arranged for conduction in the direction of a transistor conduction whereas as oppositely poled diode 46 is placed across the relay coil 40. Normally open relay contacts 48 and the controlled outlet 16 are serially connected between the fuse 44 and the line 32.

In operation, whenever there is no current flow through the controlling outlet 14 there is no base current supplied to the transistor 38 so that transistor is non-conductive and the relay coil 40 is de-energized. Then the relay contacts 48 are open and no power is applied to the controlled outlet 16. When, however, the outlet 14 is passing current to a load device, alternate half cycles of the AC current will flow through the base-emitter circuit of the transistor 38 thereby rendering that transistor conductive. The diode 36 permits conduction of the opposite half cycles of the AC current through the controlling outlet 14. Conduction of the transistor 38 permits current flow through the diode 42 and the relay coil 40 to energize the relay thereby closing the relay contacts 48 to energize the controlling outlet 16 so that a load device connected to the outlet 16 will be connected to the source 10. The diode 42 in series with the collector-emitter circuit of the transistor 38 prevents the collector-base junction of the transistor 38 from being forward biased. The diode 46 across the coil 40 prevents a destructive build up of voltage across the coil.

It will thus be seen that the power control circuit is simple and inexpensive and yet efficient to control the power supplied to the control outlet 16 according to whether there is a power demand from the outlet 14.

The embodiments of the inventionn in which an exclusive property or privilege is claimed are defined as follows:

1. A power control circuit comprising, power supply conductors for connection to a source of alternating current, a first power outlet comprising first outlet terminals adapted to be connected to an electrical load, a transistor having collector, base and emitter electrodes, means connecting said first outlet terminals and the base and emitter electrodes of said transistor in series across said power supply conductors whereby base-emitter current is supplied to said transistor through said outlet terminals to bias said transistor conductive between collector and emitter when an electrical load connects said outlet terminals to provide a current path between said outlet terminals, said base-emitter current being comprised of first half cycles of alternating current supplied through said power supply conductor, a diode, means connecting said diode and said first outlet terminals in series across said power supply conductors, said diode connected across the base and emitter electrodes of said transistor and connected to provide second opposite half cycles of alternating current supplied by said source through said first outlet terminals when an electrical load is connected thereto, a second power outlet comprising second outlet terminals connectable to a second electrical load, a relay having a coil winding and contacts, means connecting said coil winding and the collector and emitter electrodes of said transistor across said power supply conductors, and means connecting said relay contacts in series with said second outlet terminals and across said power supply conductors whereby said second outlet terminals are energized from said source of alternating current when the power control circuit is connected to a said source of alternating current and said transistor is biased conductive by base-emitter current flow through said first pair of output terminals and whereby said second outlet terminals are disconnected from said source when said first outlet terminals are open-circuited to prevent transistor base-emiter current flow.

* * * * *